United States Patent [19]

Brand et al.

[11] 4,148,523

[45] Apr. 10, 1979

[54] FOLDING ADJUSTABLE WORK STOOL

[75] Inventors: Peter Brand, Stuttgart; Guenther Haefner, Hochdorf; Fritz Diedrich, Bad Essen; Hans Kirchmann, Düren-Arnoldsweiler, all of Fed. Rep. of Germany

[73] Assignee: Heinrich Wilhelm Dreyer, Bad Essen, Fed. Rep. of Germany

[21] Appl. No.: 791,222

[22] Filed: Apr. 27, 1977

[30] Foreign Application Priority Data

Apr. 27, 1976 [DE] Fed. Rep. of Germany ..... 2618292

[51] Int. Cl.[2] ..... A47C 5/10

[52] U.S. Cl. ..... 297/55; 297/345; 297/377; 297/453

[58] Field of Search ..... 297/55, 56, 16, 19, 297/335, 338, DIG. 2, 118, 336, 453, 345, 377; 248/155

[56] References Cited

U.S. PATENT DOCUMENTS

| | | | |
|---|---|---|---|
| 1,826,643 | 10/1931 | Anderson | 297/338 |
| 2,133,047 | 10/1938 | Sheldon | 297/55 |
| 2,637,371 | 5/1953 | Boutin | 297/345 |
| 3,137,523 | 6/1964 | Karner | 297/453 |
| 3,159,428 | 12/1964 | Schier | 297/DIG. 2 |
| 3,181,828 | 5/1965 | Cramer | 297/345 X |
| 3,528,701 | 9/1970 | Laughlin | 297/377 X |
| 3,989,173 | 11/1976 | Gebhard | 297/377 |

FOREIGN PATENT DOCUMENTS

| | | | |
|---|---|---|---|
| 848402 | 9/1952 | Fed. Rep. of Germany | 297/345 |
| 1090363 | 10/1954 | France | 297/55 |

*Primary Examiner*—Francis K. Zugel

[57] ABSTRACT

The invention relates to a work stool used for a higher than normal seating position as required when working at a drafting table or the like. Features of the invention include a light weight frame that folds for storage, a wide base that does not interfere with the user's feet, and a vertically adjustable seat having a textured surface for ventilation.

38 Claims, 6 Drawing Figures

FOLDING ADJUSTABLE WORK STOOL

BACKGROUND OF THE INVENTION

High stools have long been used for seating at jobs that require a higher than normal seating position or greater than normal flexibility or frequent standing up and sitting down, such as working at a drafting table.

A stool known in the prior art features a rigid frame comprising a forward upright and a rear brace resting on parallel runners extending from side to side, which runners curve upward slightly at the ends to facilitate the user's extending sideways with a rocking motion of the stool and a seat, vertically adjustable by means of a telescoping tube located in the middle of the frame. This stool, because of its construction and the sidewards bending strain to which it is subjected, demands that the members be rugged, a requirement that results in a rather heavy stool that is difficult to handle. In addition to the handling difficulty, the construction is bulky and unfavorable for storage.

SUMMARY OF THE INVENTION

The invention relates to a work-stool featuring a substantially upright slanting seat member bearing a forward-projecting seat and a rearwardly extending floor brace, in which stool the seat member and the brace are formed from pairs of rigid members, in which stool stability is provided by widening the brace as it reaches the floor, and in which the brace may be folded flat against the seat member for storage.

Another feature of the invention is that the seat member and brace are formed from light tubes, resulting in decreased weight and easier handling compared with prior art stools.

Yet another feature of the invention is that the lower portions of the brace and the seat member are located away from the user's feet.

Yet another feature of the invention is the decrease in storage space afforded by the folding frame.

Yet another feature of the invention is the durability of the mechanism for positioning the brace at a predetermined position when the stool is in use.

Yet another feature of the invention is a hinge that is designed to facilitate mass production.

Yet another feature of the invention is the safety feature of having the rotating portion of the joint enclosed within a protective cover.

Still another feature of the invention is the comfort afforded the user by ventilation provided by texture molded into the top surface of the seat.

BRIEF DESCRIPTION OF THE DRAWING

Other features and advantages of the invention will become evident from a study of the detailed description of the drawings, in which.

DETAILED DESCRIPTION

Figure 1:
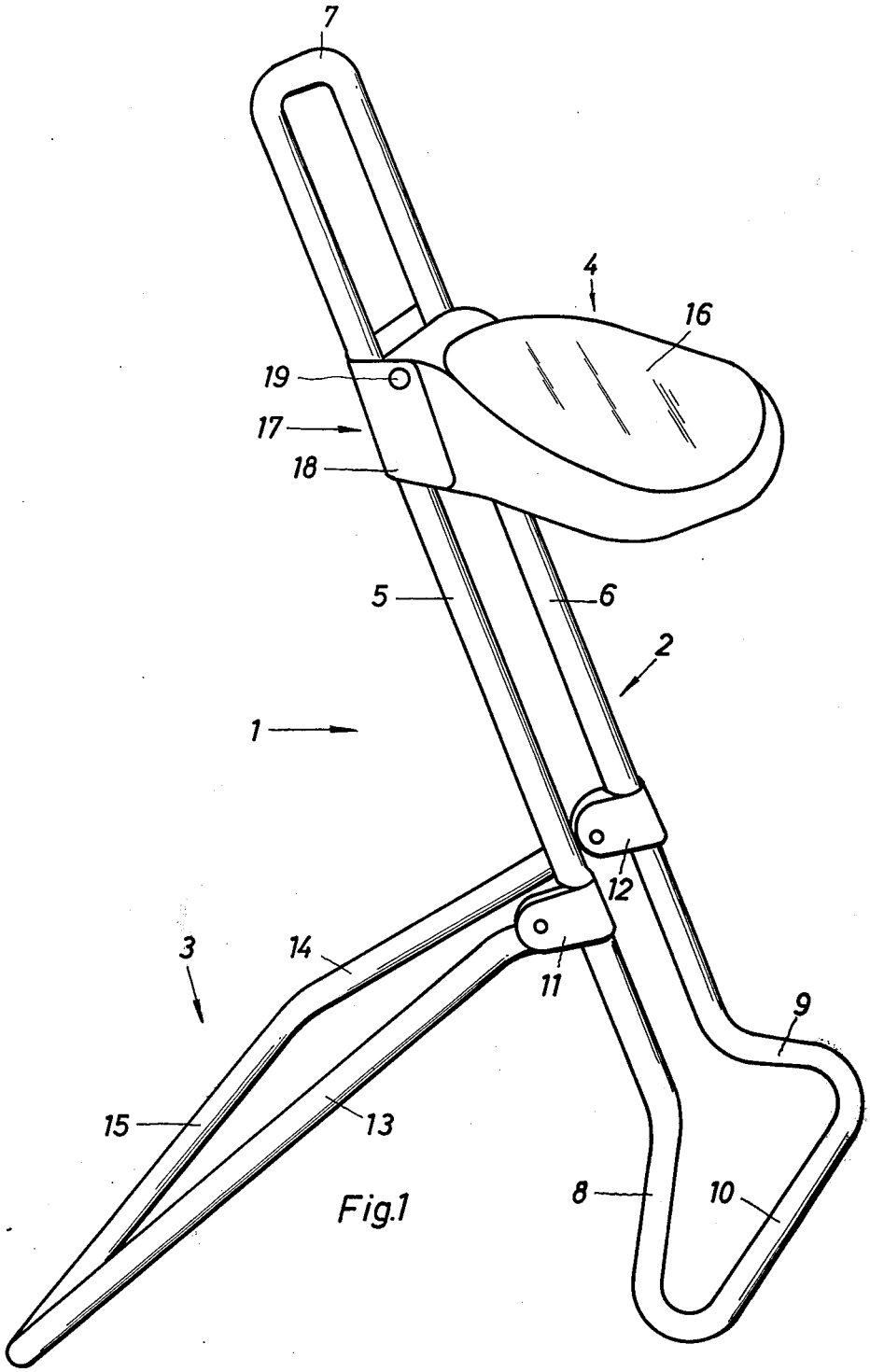
FIG. 1 shows a perspective view of a work stool according to the invention.

In FIG. 1 the main components of stool 1 are seat member 2, brace 3 disposed at the rear of seat member 3, and seat 4 projecting forward from seat member 2.

Seat member 2 illustratively comprises two parallel members 5 and 6, bent at the top to form headpiece 7 and supported at the bottom by slanting members 8 and 9, respectively, which slanting members connect with footpiece 10 to complete a symmetric frame. The frame may be formed from a single member or from several shorter pieces. The members, illustratively tubular, may have any convenient shape. Hinges 11 and 12, connecting brace 3 and members 5 and 6, are located between the middle of the frame and the connection between members 5 and 6 and members 8 and 9. Brace 3 comprises two members, 13 and 14, which extend away from the hinges to crosspiece 15, which connects their lower ends. Brace 3 is in the general shape of a trapezoid with the lower side resting on the floor and with the shorter parallel side open, having the same axis of symmetry as frame 2 and being composed of a single tubular member.

Hinges 11 and 12 position brace 3 at the correct angle and also swing to position brace 3 flat against frame 2. In the spread position shown in FIG. 1, the spread is limited by a stop, not shown, so that the stool may be set up with footpiece 10 on one side and crosspiece 15 on the other side. Brace 3 is positioned substantially at right angles to frame 2.

Figure 2:
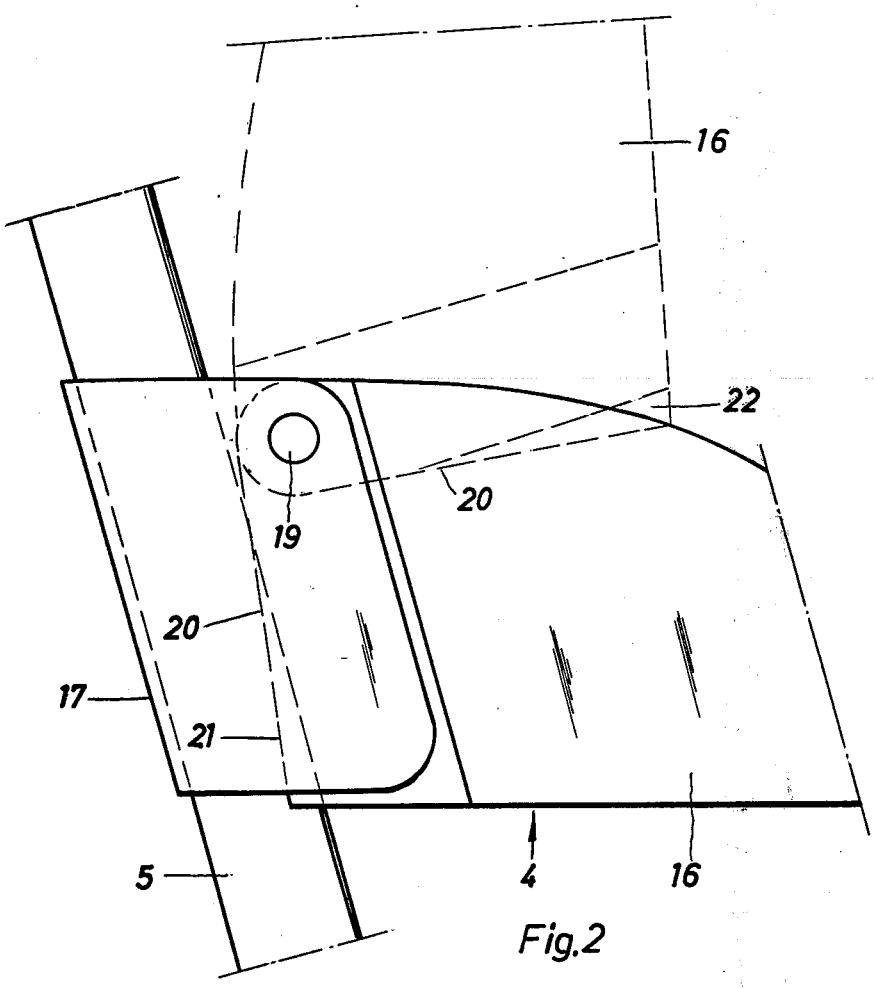
FIG. 2 shows a side view of the connection between the frame and the seat.

Seat 4 comprises seat body 16 and mounting 17. Mounting 17 passes behind members 5 and 6 on the same side as brace 3 and extends outward with forward projecting ears 18 on both sides of seat body 16, which seat body projects forward substantially horizontally when stool 1 is in its use position. Seat body 16 and projecting ears 18 are fastened together in the upper portion of the projecting ears 18 with two colinear rivets 19, which define a rotation axis about which seat body 16 may be rotated up against frame 2 as shown in FIG. 2. In the lowered position, that part of seat body 16 that is within mounting 17 rests against members 5 and 6 so that when the weight on seat body 16 is increased, the pressure on members 5 and 6 is also increased and the vertical position is maintained by the increased friction. On the other hand, by lifting the seat, the friction may be eliminated so that the vertical position of the seat may be changed.

A detailed elevation showing the adjustment and bracing of seat 4 against frame 2 is shown in FIG. 2 in which a portion of member 5, a portion of seat body 16 (the in-use position in solid lines; the folded position in broken lines), mount 17 and one of rivets 19 is displayed. In the use position the lower portion (21) of rear edge 20 of seat body 16 presses against members 5 and 6. Rear face 22 of the seat body is indicated in the raised position in FIG. 2. Face 22 increases the clamping effect on tubes 5 and 6 of mounting 17 on the one side and seat body 16 on the other. In the upper region, especially near rivets 19, rear edge 20 of seat body 16 is separated well enough from tubes 5 and 6 to permit the folding of seat body 16 and for the vertical adjustment of seat 4 in the folded position. It should be understood that fastening means of conventional type may be used in place of the mechanism described above.

Figure 3:
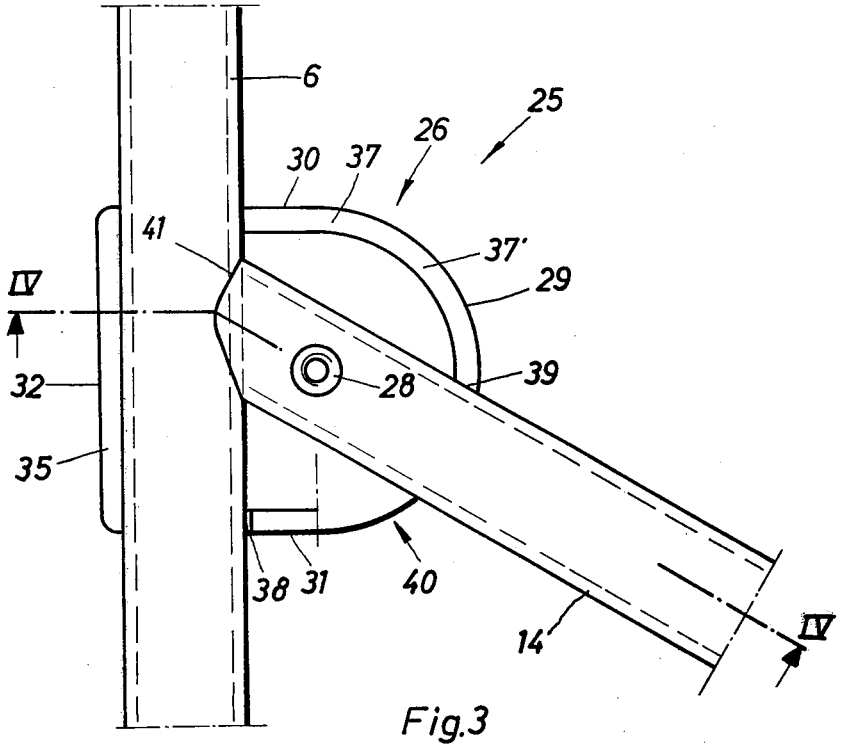
FIG. 3 shows a side view of one of the hinges joining the brace and the seat member.
Figure 4:
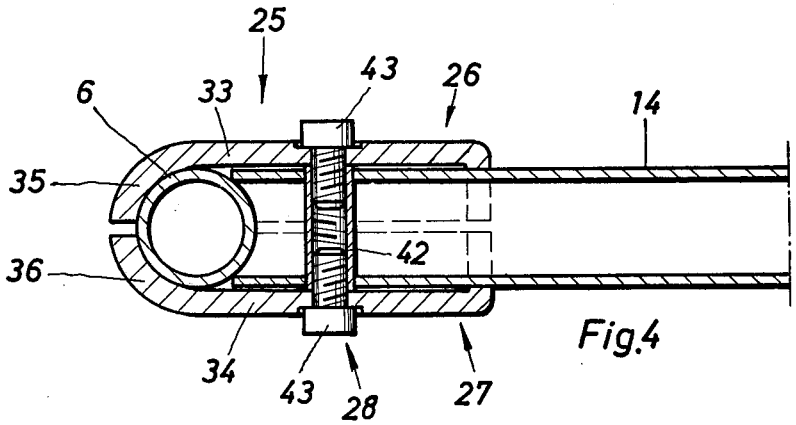
FIG. 4 is a section along line IV—IV in FIG. 3.

FIGS. 3 and 4 are detail views of the hinge 12. The hinge between tube 6 and brace 14 is indicated as number 25, and is formed from two gripping members 26 and 27 and pivot 28. Gripping members 26 and 27 are mirror images of one another. One end 35 of gripping member 26 curves out of the plane of the paper in FIG. 3, for gripping frame-member 6. The other end has a horseshoe shape 29 in that the outline of the member is a half circle centered on pivot 28, having a flange (30, 31) projecting out of the plane of the paper in FIG. 3. Flanges 30, 31 are shown in broken lines in FIG. 4, which is a section looking upward along line IV—IV. in FIG. 3. Near member 6, flanges 30, 31 are parallel to each other and perpendicular to edge 32 of end 35. As can be seen in FIG. 4, flanges 30, 31 and 35 all project equally far from the plane of the paper in FIG. 3, which paper plane is the plane of the main portion 33 of member 26. The corresponding portion 34 of member 27 is substantially parallel to portion 33. The distance between portions 33 and 34 is set so that there is clearance for the rotation of member 14 through opening 40.

Member 6 is prevented from moving out of the plane of the paper in FIG. 3 by the pressure of curved portions 35 and 36. It is prevented from moving sideways in the plane of the paper by edge 32 of curved portion 35 and those edges of flanges 30 and 31 that are in proximity with member 6. Curved portions 35 and 36 are formed to mate closely with member 6. Flange 30 ends at edge 39, against which member 14 rests when the seat is in the use position. The extension of flanges 30 and 31 toward the other gripping member provides a safety feature in that the enclosure of the pivoting area thus effected eliminates the danger of pinching when the frame is set up.

Member 14 pivots about pivot 28 which passes through member 14 a certain distance from end 41. This distance is so chosen that in the use position end 41 of brace member 14 touches the outside of member 6. End 41 is shaped to contact member 6 over a large area and thus to avoid the high pressures and resulting deformations that would result from a small contact area. Pivot 28 comprises a hollow pivot 42 with inner threads and threaded pivots or screws 43 which fasten gripping members 26 and 27 to pivot 42. Pivot 42 spaces members 26 and 27 by a predetermined distance. Pivot 42 passes through member 14 and has a smooth cylindrical surface that facilitates the pivoting of member 14 about pivot 28.

This pivot mechanism is simple, inexpensive, easy to fabricate in mass production and safe. Further, the direct contact between the brace members and the first member forms a highly desirable and reliable stop. In addition, pressure of member 14 against edge 39 relieves the burden on pivot 28.

Figure 5:
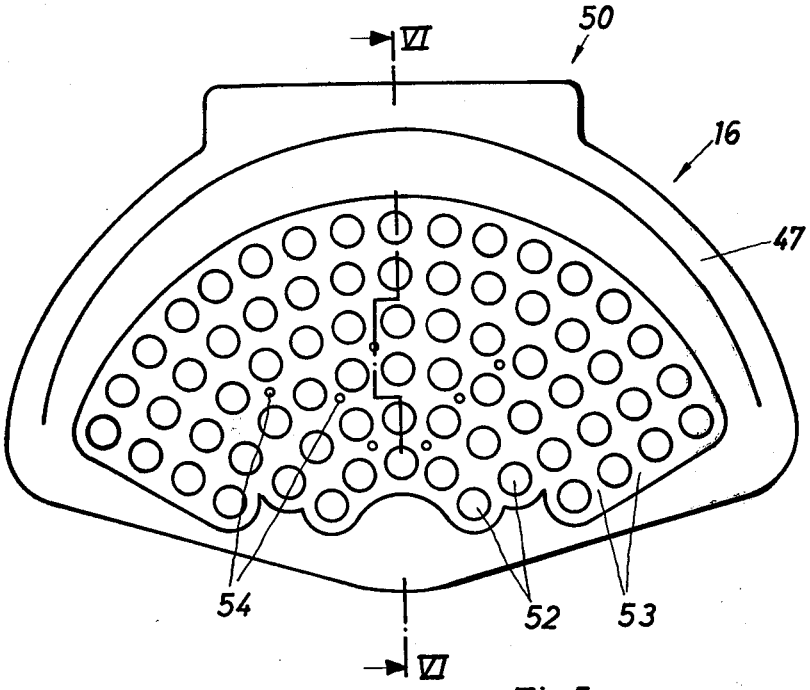
FIG. 5 shows a plan view of the seat.
Figure 6:
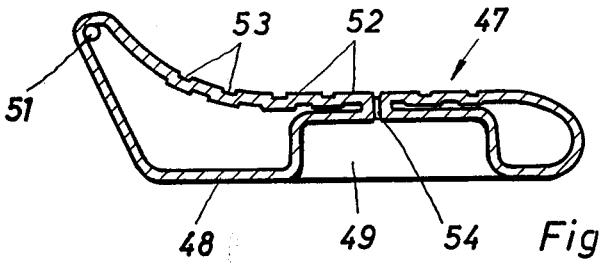
FIG. 6 shows a section of the seat along line VI—VI in FIG. 5.

FIGS. 5 and 6 show the seat in more detail. The shape of the seat is wider and flatter than a saddle. Seat 16 is hollow, double-shelled and blown out of one piece of plastic. As the section in FIG. 6 shows, it has a top surface contoured to fit the body with a high back and side edge and a rather flat bottom surface 48, which bottom 48 includes a molded grip 49. At the back there is a mounting 50 with a hole 51 for a fastener, so that the seat can be pivoted up to lie against frame 2.

Surface 47 is textured with a plurality of nubs 52 and a pattern of interconnected grooves 53 that is open to several sides. This channel system facilitates the ventilation of surface 47 in use, since the openness of the grooves permits the rapid dissipation of moisture. With the smoothly rounded nubs there is less damage and abrasion to clothing. At the same time the channel system is shallow for easy cleaning. For better ventilation of the main part of seat body 16, there are additional ventilation holes 54 in the channel 15. In the area surrounding holes 54, the top and bottom surfaces are connected together so that a direct ventilation passage is provided through seat body 16.

Obviously, the seat described above may be produced in many similar equivalent shapes and from many equivalent materials, such as plywood.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A collapsible stool for resting on a floor having a closed frame and a seat vertically adjustably mounted on said frame, said frame includes a rearwardly slanting pair of first parallel supporting members rigidly connected to each other to form a closed frame for supporting a seat projecting forwardly from said pair of first supporting members at a first acute angle, said pair of first supporting members is supported relative to the floor by a brace extending downward and backward within a second acute angle from a rear side of said first supporting members, said brace comprises a pair of rigidly connected diverging brace members, said pair of brace members pivotally connected to said pair of first supporting members by means of a pair of hinges and being connected to each other at their bottom by a second cross-piece so that the brace is shaped as a trapezoid having an open top side parallel to and shorter than said second cross-piece, said closed frame formed by said first supporting members being of symmetric trapezoidal shape at its lower end and having a first cross-piece resting on the floor forming the base of the trapezoidal shape, said first cross-piece being longer than the distance between said parallel first supporting members, a pair of divergent slanting members connect said first cross-piece to said pair of first supporting members, thereby completing said closed frame.

2. A stool according to claim 1, wherein said brace and said frame are composed of tubular members.

3. A stool according to claim 1, wherein said first members extend throughout an adjusting range and in that said seat is vertically adjustable over said range.

4. A stool according to claim 3, wherein said seat is pivotably mounted so that said seat can be folded up against said frame.

5. A stool according to claim 1, wherein said hinges between said brace members and said first members are each formed from two gripping members having first and second ends and connected by fastening means, which first ends of said gripping members grip said first members, and between which second ends of said gripping members said brace members pivot about said fastening means, and said fastening means pass through holes located a predetermined distance from an end of said brace member, so that said ends of said brace members press against said first members when said brace is in said predetermined position during use, whereby said ends of said brace members form said stopping means.

6. A stool according to claim 5, wherein at least one of said gripping members is partially formed into a plurality of flanges projecting toward the other one of said gripping member, whereby said first member is gripped by said plurality of projecting flanges.

7. A stool according to claim 6, wherein one of said projecting flanges presses against said brace member when said brace is in said predetermined position, whereby said projecting flange forms a stop for said brace.

8. A stool according to claim 6, wherein said gripping members are mirror images of one another.

9. A stool according to claim 8, wherein said second ends of said gripping members include projecting flanges of semicircular outline, centered on said fastening means.

10. A stool according to claim 6, wherein said first ends of said gripping members are shaped to fit snugly about said first members.

11. A stool according to claim 1, wherein said seat comprises a contoured hollow seat body formed of plastic.

12. A stool according to claim 11, wherein said seat body has a surface pattern of nubs, between which nubs runs an array of shallow grooves open to at least one side of said seat body.

13. A stool according to claim 12, wherein said nubs are smoothly rounded off.

14. A stool according to claim 13, wherein said seat body is perforated by a plurality of ventilation holes.

15. A stool according to claim 1, further characterized in that said hinges between said brace members and said first members are each formed from two gripping members having first and second ends and connected by fastening means, which first ends of said gripping members grip said first members, and between which second ends of said gripping members said brace members pivot about said fastening means, and in that said fastening means pass through holes located a predetermined distance from an end of said brace member, so that said ends of said brace members press against said first members when said brace is in said predetermined position during use, whereby said ends of said brace members form said stopping means.

16. A stool according to claim 15, further characterized in that at least one of said gripping members is partially formed into a plurality of flanges projecting toward the other one of said gripping members, whereby said first member is gripped by said plurality of projecting flanges.

17. A stool according to claim 16, further characterized in that one of said projecting flanges presses against said brace member when said brace is in said predetermined position, whereby said projecting flange forms a stop for said brace.

18. A stool according to claim 16, further characterized in that said gripping members are mirror images of one another.

19. A stool according to claim 18, further characterized in that said second ends of said gripping members include projecting flanges of semi-circular outline, centered on said fastening means.

20. A stool according to claim 16, further characterized in that said first ends of said gripping members are shaped to fit snugly about the first members.

21. A stool according to claim 1, further characterized in that said seat comprises a contoured hollow seat body formed of durable plastic.

22. A stool according to claim 21, further characterized in that said seat body has a surface pattern of nubs, between which nubs runs an array of shallow grooves open to at least one side of said seat body.

23. A stool according to claim 22, further characterized in that said nubs are smoothly rounded off.

24. A stool according to claim 23, further characterized in that said seat body is perforated by a plurality of ventilation holes.

25. A stool according to claim 16, further characterized in that said seat comprises a contoured hollow seat body formed of durable plastic.

26. A stool according to claim 25, further characterized in that said seat body has a surface pattern of nubs, between which nubs runs an array of shallow grooves open to at least one side of said seat body.

27. A stool according to claim 26, further characterized in that said nubs are smoothly rounded off.

28. A stool according to claim 27, further characterized in that said seat body is perforated by a plurality of ventilation holes.

29. A stool according to claim 2, further characterized in that said hinges between said brace members and said first members are each formed from two gripping members having first and second ends and connected by fastening means, which first ends of said gripping members grip said first members, and between which second ends of said gripping members said brace members pivot about said fastening means, and in that said fastening means pass through holes located a predetermined distance from an end of said brace member, so that said ends of said brace members press against said first members when said brace is in said predetermined position during use, whereby said ends of said brace members form said stopping means.

30. A stool according to claim 29, further characterized in that at least one of said gripping members is partially formed into a plurality of flanges projecting toward the other one of said gripping members, whereby said first member is gripped by said plurality of projecting flanges.

31. A stool according to claim 30, further characterized in that one of said projecting flanges presses against said brace member when said brace is in said predetermined position, whereby said projecting flange forms a stop for said brace.

32. A stool according to claim 30, further characterized in that said gripping members are mirror images of one another.

33. A stool according to claim 32, further characterized in that said second ends of said gripping members include projecting flanges of semi-circular outline, centered on said fastening means.

34. A stool in accordance with claim 30, further characterized in that said first ends of said gripping members are shaped to fit snugly about said first members.

35. A stool according to claim 34, further characterized in that said seat comprises a contoured hollow seat body formed of plastic.

36. A stool according to claim 35, further characterized in that said seat body has a surface pattern of nubs, between which nubs runs an array of shallow grooves open to at least one side of said seat body.

37. A stool according to claim 36, further characterized in that said nubs are smoothly rounded off.

38. A stool according to claim 37, further characterized in that said seat body is perforated by a plurality of ventilation holes.

* * * * *